United States Patent [19]

Vuilleumier

[11] Patent Number: 4,555,185

[45] Date of Patent: Nov. 26, 1985

[54] TIME SETTING MECHANISM FOR A TIMEPIECE HAVING AN ANALOG MECHANICAL DISPLAY

[75] Inventor: Cyril Vuilleumier, Bienne, Switzerland

[73] Assignee: Omega SA, Bienne, Switzerland

[21] Appl. No.: 549,859

[22] Filed: Nov. 8, 1983

[30] Foreign Application Priority Data

Nov. 9, 1982 [CH] Switzerland ..... 6502/82

[51] Int. Cl.[4] ..... G04B 27/02

[52] U.S. Cl. ..... 368/190; 368/199; 368/319; 368/184; 368/185

[58] Field of Search ..... 368/190, 184, 185, 319

[56] References Cited

U.S. PATENT DOCUMENTS 3,623,315 11/1971 Christe ..... 368/190
3,972,177 8/1976 Vuilleumier ..... 58/63

FOREIGN PATENT DOCUMENTS 158882 12/1932 Switzerland ..... 368/190
367762 2/1963 Switzerland .
394959 3/1965 Switzerland ..... 368/190
592329 7/1977 Switzerland .
611759 6/1979 Switzerland .

*Primary Examiner*—Bernard Roskoski
*Attorney, Agent, or Firm*—Griffin, Branigan & Butler

[57] ABSTRACT

This mechanism is intended for time setting of an analog mechanical display in a timepiece. It comprises a manually operable crowned stem (1) arranged to be toggled into at least two axial positions the active one of which is drawn-out relative to the neutral pushed-in position. The stem is provided with a toothed pinion (3) which meshes with an axially displaceable pinion (6). Such pinions are placed side-by-side and a mechanism including a trigger piece (9), a rocking lever (10) and a slider (21) slaves the axially displaceable pinion to the stem. The arrangement is compact and readily integrated into a thin timepiece.

9 Claims, 4 Drawing Figures

TIME SETTING MECHANISM FOR A TIMEPIECE HAVING AN ANALOG MECHANICAL DISPLAY

BACKGROUND OF THE INVENTION

This invention concerns a mechanism for a timepiece having a analog mechanical display with at least an hours hand and a minutes hand and comprises a manually operable crowned stem capable of being toggled into at least two axial positions, an axially displaceable pinion and means slaving the pinion to the stem whereby the pinion may assume at least two distinct positions as determined by the axial positions of the stem.

Such a mechanism is well known from the state of the art. If reference be made for instance to Swiss Pat. No. 611 759 and to the figure shown therein, there will be found a mechanism comprising a stem 4 serving at the same time to wind the watch and to set the hands thereof. The time setting function is assured by an axially displaceable pinion which comprises a sliding pinion 8 which may slide on a squared portion of the stem, and thus in accordance with the axial position of the stem may engage an intermediate setting wheel 25. Pinion 8 is slaved to the stem 4 by the mechanism formed by the trigger piece 1 and the rocking lever 2. It will be observed that in this construction the diameter of the sliding pinion 8 is clearly much greater than the diameter of the stem and that consequently such a construction is poorly adapted to a watch of very small thickness in accordance with current styling.

To overcome this difficulty it has been proposed to mount the sliding pinion at the end of a stem, this enabling said pinion a diameter which does not exceed the diameter of the stem. Such a construction however requires the manufacture of components which are difficult to obtain in practice and at the same time leads to an elongated mechanism which is difficult to place within the movement.

To overcome these disadvantages, the present invention proposes a new construction which will appear from the means defined in the claims.

DETAILED DESCRIPTION OF THE INVENTION

Figure 1:
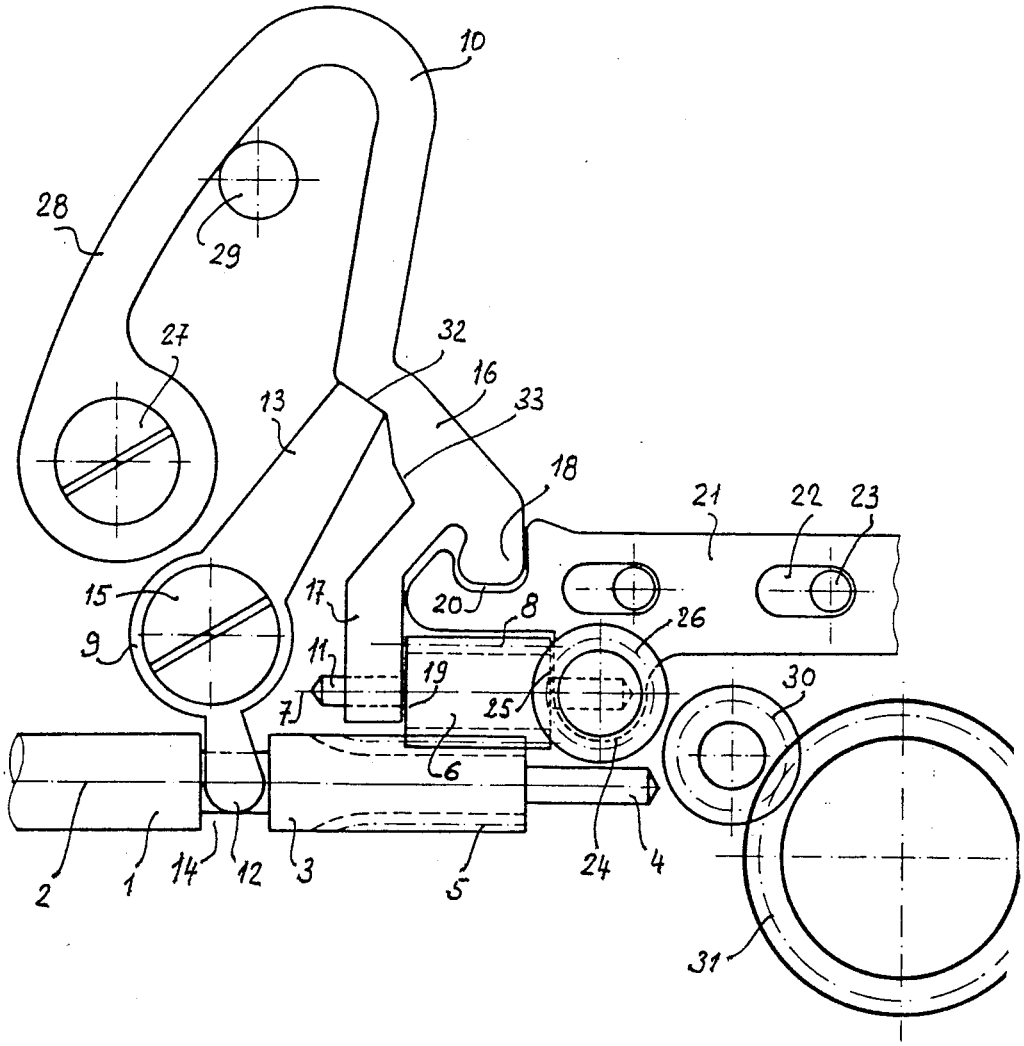
FIG. 1 is a plan view of the time setting mechanism according to the invention in which the stem is shown in the pushed-in neutral position.
Figure 2:
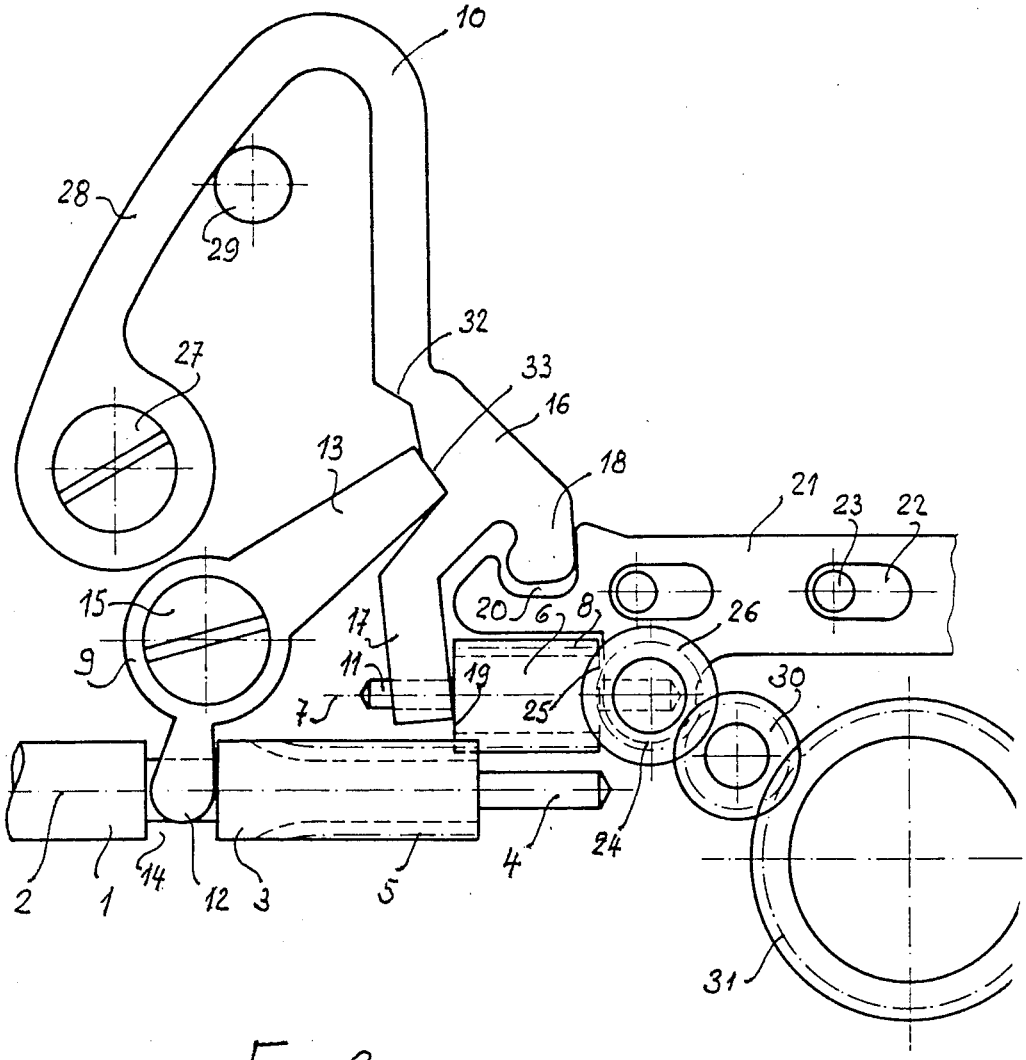
FIG. 2 is a plan view of the time setting mechanism according to the invention in which the stem is shown in the drawn-out active position.

The mechanism shown in FIGS. 1 and 2 is adapted to electronic watch calibers not having winding stems and equipped with at least an hours hand and a minutes hand. The time setting stem 1 is rotatively mounted on the base plate about axis 2. It may take either of two axial positions when the user acts on the crown (not shown) which is mounted thereon. The first or neutral position is shown in FIG. 1 and the second withdrawn position is shown in FIG. 2.

The stem comprises in its elongation a toothed pinion 3 of which the diameter does not exceed that of the stem. The pinion 3 is either force-fitted onto a shaft solid with the stem or manufactured as a single integral portion of the stem. Pinion 3 is provided with a classical toothing 5. The figures show also that the mechanism comprises an axially displaceable pinion 6 rotatively mounted relative to an axis 7 arranged parallel to the axis 2 of the stem.

Pinion 6 plays the same role as that of the sliding pinion as usually found and as has been described in Swiss patent 611 759 except to the extent that in the present case the winding function does not exist. In order to simplify the language however it will be continued to be referred to as the sliding pinion although this definition does not exactly correspond to the idea normally presented concerning such a mechanism.

Axes 2 and 7 are arranged relative to one another in order that the toothing 5 of pinion 3 meshes with the toothing 8 of the sliding pinion 6. The figures show further that sliding pinion 6 is slaved to pinion 3 by a system including a trigger piece 9 and rocking lever 10 in a manner such that in the withdrawn position of the stem relative to the neutral pushed-in position the time setting of the watch is activated when the stem is thereafter manually rotated.

The figures show that the sliding pinion 6 is solid or integral with a shaft 11 itself rotatively mounted on the base plate by means of bearings which are not shown. As a variant the sliding pinion could of course be freely mounted on a shaft which would then be solidly mounted onto the base plate.

The trigger piece 9 comprises a stud 12 and a nose 13. Stud 12 is engaged in a groove 14 formed by a space provided between stem 1 and toothed pinion 3. When the stem changes its axial position the trigger piece is driven into a pivoting motion about its pivot axis shown here as a screw 15. Nose 13 of the trigger piece cooperates with an arm 16 or rocking lever 10, this latter being elastically deformable. In order for this to occur, the rocking lever is maintained fixed relative to the base plate by means of a screw 27 situated at the end of its arm 28. A retaining pin 29 defines an angular and precise displacement of the other arm 16. At the end of arm 16 and integral therewith, there will be found a two-armed fork 17 and 18. Arm 17 may contact the flank 19 of the sliding pinion and arm 18 forming a knee is freely engaged in a cut-out 20 of slider 21. Slider 21 comprises slots 22 into which may penetrate pins 23 in order to guide the slider which may displaced parallel to axis 2 of stem 1 when the slider is driven by knee 18. The slider 21 includes moreover a portion 24 which contacts the flank 25 of the sliding pinion. Thus, the sliding pinion 6 is sandwiched between arm 17 of rocking lever 10 and the portion 24 of slider 21 and may be axially displaced along its axis 7 according to the position of the rocking lever. The figures show also that the portion 24 bears an intermediate wheel 26 which meshes permanently with the sliding pinion. Intermediate wheel 26 may mesh with a gear train comprising here a further intermediate wheel 30 and a motion work wheel 31 pivoted onto the base plate.

FIG. 1 shows the position of the mechanism when the time setting stem is in its neutral pushed-in position. In this position nose 13 of the trigger piece bears against the inclined plane 32 of the rocking lever 10. Slider 21 is displaced to the left in the drawing by knee 18. Sliding pinion 6 is thus positioned towards the left by the portion 24 of the slider and the intermediate wheel 26 does not mesh with the gear train 30 and 31. Should one rotate stem 1 nothing further will occur.

FIG. 2 shows the position of the same mechanism when the time setting stem is in the drawn-out position. In this latter position nose 13 of the trigger piece places arm 16 of rocking lever 10 towards the right and is toggled onto the inclined plane 33. Arm 17 of the fork pushes the sliding pinion 6 as well as slider 21 towards the right and intermediate wheel 26 comes into mesh with the gear train 30 and 31. Should one rotate stem 1 the hands of the watch will turn.

Figure 3:
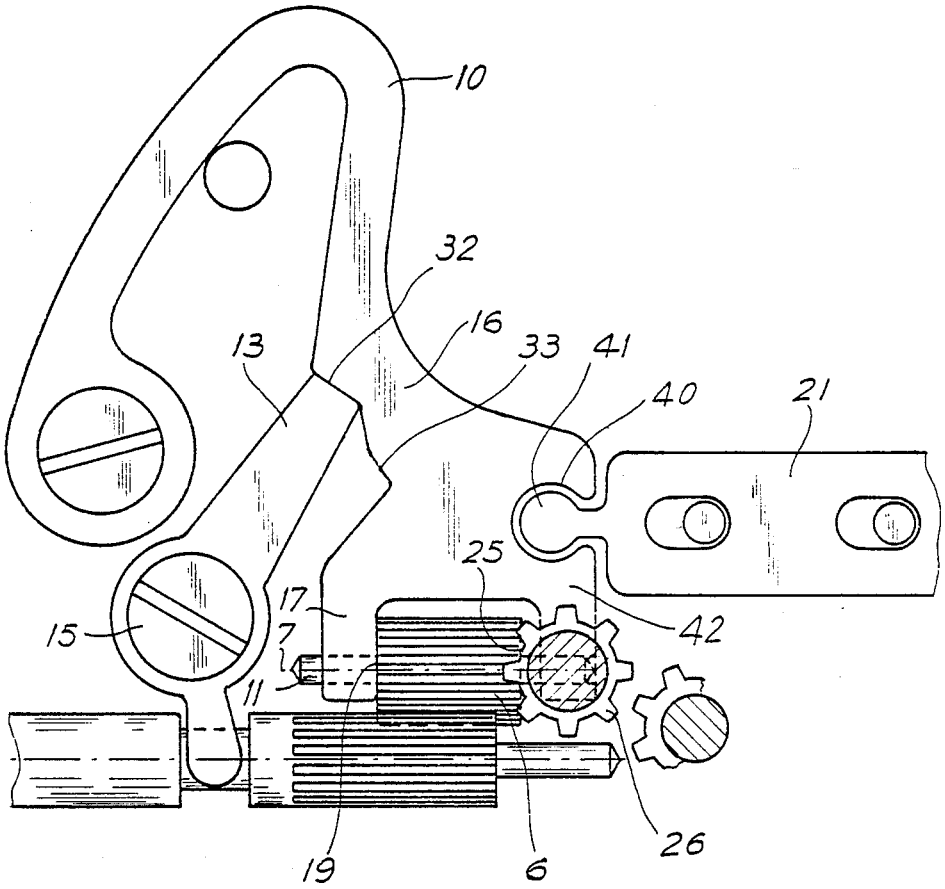
FIG. 3 is a plan view of an alternative embodiment of the invention wherein a sliding pinion and an intermediate wheel are fully supported by a rocking lever.

In a variant shown arm in FIG. 3 16 of the rocking lever is not terminated by a knee 18 but by a similar branch 42 to that shown at 17. Thus the fork may have two equal arms of which one bears the intermediate wheel 26, said arms embracing pinion 6 on its flanks 19 and 25. In this variant, the slider 21, the purpose of which will be explained further along, may be coupled to the rocking lever by means of a joint 40, 47 or could also be made integral with said rocking lever.

Figure 4:
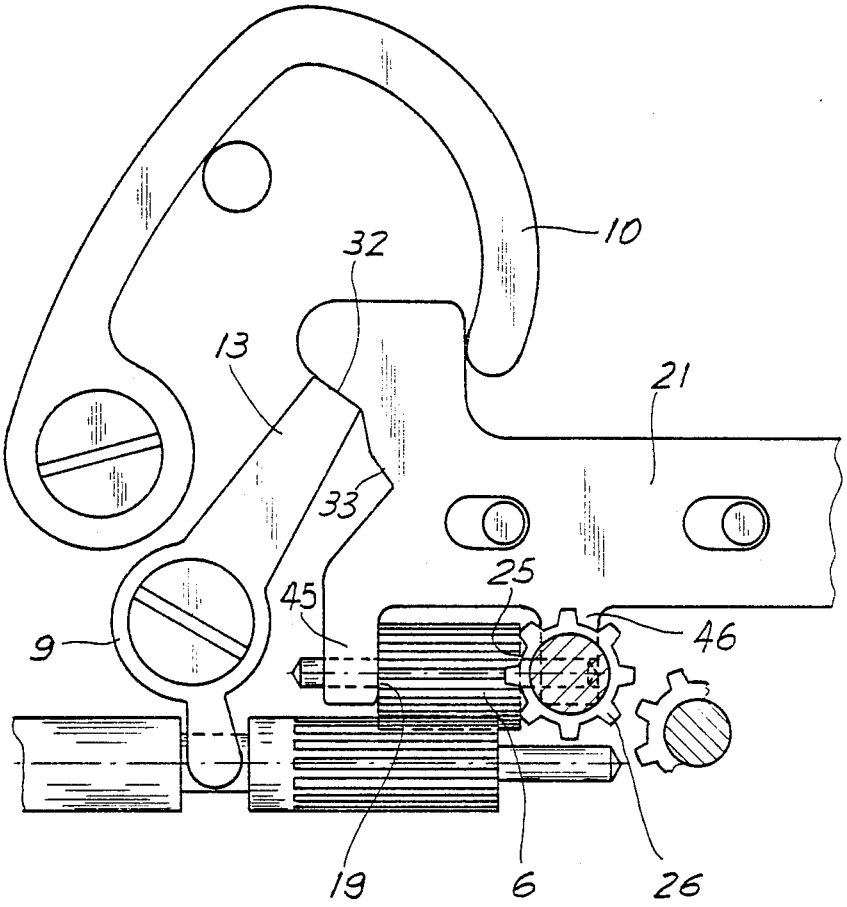
FIG. 4 is a plan view of a further embodiment of the invention wherein the sliding pinion and intermediate wheel are fully supported by a slider.

In a still further variant of the invention (shown in FIG. 4), the trigger piece 9 cooperates directly with slider 21. When the trigger piece is brought into rotation its nose acts on the slider. In this variant, it is the slider which bears a two-armed fork 45 and 46 which embraces the sliding pinion to enable axial displacement thereof. In such case, the rocking lever 10 acts as a simple return spring for the slider 21.

Slider 21 may serve to control the stopping of the watch. Its prolongation (not shown) actuates, on one hand, an electrical contact which serves to interrupt the electric current to the motor. The slider controls, on the other hand, a mechanical brake which acts for instance on a seconds wheel to avoid damaging the motor which, without such, would turn at an increased speed during mechanical time setting.

The construction which has just been described permits above all to reduce thickness since, as has already been mentioned above, there is no longer a pinion sliding directly on the stem. The components are of classical form thus easy to manufacture. For example, machining the stem which even with its toothed pinion does not exceed a diameter of 0.8 mm poses no problems. The stem is then introduced into an orifice arranged on the base plate whilst the sliding pinion may be placed at a location disengaged from said base plate. In such manner, the sliding pinion diameter may be greater as shown in the drawing than the diameter of the pinion borne on the stem and this with the purpose of facilitating still further the manufacture thereof.

What I claim is:

1. A time setting mechanism for a timepiece having an analog mechanical display with at least an hours hand and a minutes hand comprising a manually operable crowned stem capable of being toggled into at least two axial positions, an axially displaceable pinion and means slaving said pinion to the stem whereby the pinion may assume at least two distinct positions as determined by the axial positions of the stem, said stem including a toothed pinion, the axially displaceable pinion being rotatively mounted about an axis parallel to the stem axis, said axes being non-coincidently arranged in a manner such that the respective pinions mesh with one another and the slaving means being arranged and adapted such that with the stem in a drawn-out axial position the axially displaceable pinion drives the time setting gears when the stem is rotated.

2. A time setting mechanism as set forth in claim 1 wherein the axially displaceable pinion is fixed to a shaft rotatively mounted on the timepiece base plate.

3. A time setting mechanism as set forth in claim 1 wherein the slaving mechanism comprises a trigger piece driven into pivoting movement when the stem changes its axial position and a rocking lever which is elastically deformed by the trigger piece whenever the stem is in its drawn-out axial position, said rocking lever including a forked branch arranged to embrace the axially displaceable pinion in order to effect the axial displacement thereof.

4. A time setting mechanism as set forth in claim 3 wherein one arm of the fork carries an intermediate wheel arranged to mesh permanently with the axially displaceable pinion.

5. A time setting mechanism as set forth in claim 1 wherein the slaving mechanism comprises a trigger piece driven into pivoting movement when the stem changes its axial position, a rocking lever which is elastically deformed by the trigger piece whenever the stem is in its drawn-out axial position and a slider governed by the rocking lever, the rocking lever and slider being arranged to embrace the axially displaceable pinion in order to effect the axial displacement thereof.

6. A time setting mechanism as set forth in claim 5 wherein the slider carries an intermediate wheel arranged to mesh permanently with the axially displaceable pinion.

7. A time setting mechanism as set forth in claim 1 wherein the slaving mechansim comprises a trigger piece driven into pivoting movement when the stem changes its axial position, a slider cooperating with the trigger piece, said slider including a fork arranged to embrace the axially displaceable pinion so as to effect the axial displacement thereof and a rocking lever arranged and adapted to provide a return spring for the slider.

8. A time setting mechanism as set forth in claim 7 wherein the slider carries an intermediate wheel arranged to mesh permanently with the axially displaceable pinion.

9. A time setting mechanism as set forth in claim 4 or in claim 6 or in claim 8 wherein the intermediate wheel is engaged with a gear train whenever the stem is in its drawn-out axial position and is disengaged from said gear train whenever the stem is in a pushed-in axial position.

* * * * *